US009492359B2

(12) United States Patent
Bateman

(10) Patent No.: US 9,492,359 B2
(45) Date of Patent: Nov. 15, 2016

(54) SOOTHER-LIKE ARTICLE FOR MEDICAL PURPOSES

(76) Inventor: Nicola Jane Bateman, Bordon (GB)

( * ) Notice: Subject to any disclaimer, the term of this patent is extended or adjusted under 35 U.S.C. 154(b) by 0 days.

(21) Appl. No.: 13/981,575

(22) PCT Filed: Jan. 27, 2012

(86) PCT No.: PCT/GB2012/000082

§ 371 (c)(1),
(2), (4) Date: Jul. 24, 2013

(87) PCT Pub. No.: WO2012/101409

PCT Pub. Date: Aug. 2, 2012

(65) Prior Publication Data

US 2013/0304122 A1 Nov. 14, 2013

(30) Foreign Application Priority Data

Jan. 27, 2011 (GB) ..... 1101434.7

(51) Int. Cl.
*A61J 17/00* (2006.01)
*A61J 11/00* (2006.01)

(52) U.S. Cl.
CPC ..... *A61J 17/00* (2013.01); *A61J 11/004* (2013.01); *A61J 17/008* (2015.05)

(58) Field of Classification Search
CPC ..... A61J 11/004; A61J 2017/008; A61J 2017/001; A61J 2017/006; A61J
(Continued)

(56) References Cited

U.S. PATENT DOCUMENTS 4,909,253 A * 3/1990 Cook et al. ..... 606/234
5,275,619 A 1/1994 Engebretson et al.
(Continued)

FOREIGN PATENT DOCUMENTS

DE 38 40 178 A1 5/1990
DE 103 00 899 A1 7/2004
(Continued)

OTHER PUBLICATIONS

International Search Report and Written Opinion for corresponding international application PCT/GB2012/000082, mailed May 11, 2012, 8 pages.
(Continued)

*Primary Examiner* — Katrina Stransky
*Assistant Examiner* — Katherine Schwiker
(74) *Attorney, Agent, or Firm* — Bookoff McAndrews, PLLC

(57) ABSTRACT

A medical article resembling a soother has a teat portion for insertion into a baby's mouth and a mouth shield portion adapted to fit over the baby's face around the mouth and serving in use to limit the extent of insertion of the teat portion into the baby's mouth. The teat portion is of sufficient length and extends from the mouth shield at an angle towards the hard palate in the roof of the mouth when the shield is so fitted whereby a distal end portion of the teat portion is adapted in use to bear against the hard palate in the roof of the mouth. The teat portion is formed without voids with a relatively soft surface layer and a relatively harder inner core.

16 Claims, 9 Drawing Sheets

(58) Field of Classification Search
CPC ..... 17/00;A61J 11/00; A61J 11/0005; A61J 11/001; A61J 11/0015; A61J 11/002; A61J 11/0025; A61J 11/003; A61J 11/0035; A61J 11/0045; A61J 11/005; A61J 11/0055; A61J 11/0065; A61J 11/007; A61J 17/002; A61J 17/003; A61J 17/005; A61J 17/006; A61J 17/007; A61J 17/008; A61J 17/02; A61H 13/00
USPC ..... 606/234–236; 215/11.1–11.6; D24/194–196
See application file for complete search history.

(56) References Cited

U.S. PATENT DOCUMENTS

| | | | | |
|---|---|---|---|---|
| 5,342,398 | A * | 8/1994 | Sun | A61J 17/00 606/234 |
| 6,447,536 | B1 * | 9/2002 | Hinshaw | A61J 17/00 606/235 |
| 2003/0181947 | A1 | 9/2003 | Struckmeier et al. | |
| 2008/0188894 | A1 * | 8/2008 | Hakim | 606/236 |
| 2009/0076548 | A1 * | 3/2009 | Letsche | A61J 17/02 606/235 |
| 2011/0218569 | A1 | 9/2011 | Tesini et al. | |

FOREIGN PATENT DOCUMENTS

| | | |
|---|---|---|
| DE | 10 2007 059180 A1 | 6/2009 |
| EP | 1 424 057 A1 | 6/2004 |
| WO | WO 00/10505 | 3/2000 |

OTHER PUBLICATIONS

British Standard, "Child Use and Care Articles—Soothers for Babies and Young Children," BS EN 1400-1:2002, Sep. 2002, 30 pages.

* cited by examiner

SOOTHER-LIKE ARTICLE FOR MEDICAL PURPOSES

CROSS-REFERENCE TO RELATED APPLICATIONS

This application is a National Stage filing under 35 U.S.C. §371 of International Application No. PCT/GB2012/000082, filed Jan. 27, 2012, which claims priority to British Patent Application No. 1101434.7, filed Jan. 27, 2011, the contents of each of which are incorporated by reference herein.

FIELD OF DISCLOSURE

This disclosure relates to articles resembling soothers but for medical purposes.

BACKGROUND

A soother, as defined in British Standard BS EN 14001-1:2002, the English language version of European Standard EN 1400-1 (September 2002), is an article intended for satisfying the non-nutritive sucking need of children. Soothers are also known as pacifiers or babies' dummies.

Soothers typically comprise: a teat, namely a flexible nipple designed to be placed in the mouth; a shield positioned at the rear of the teat to reduce the likelihood of the soother being drawn entirely into the mouth, and with ventilation openings to ensure that a child can continue to breath with the teat in its mouth; and a ring and/or knob on the side of the shield opposite from the direction in which the teat extends, allowing the soother to be grasped by an adult. The aforesaid Standard requires that the teat be hollow and filled with air. The soother will accordingly usually have a plug closing a neck of the teat and serving to secure it to the shield.

Babies are born with a sucking reflex. Newborn and premature babies are subject to the post traumatic stress of labour, especially after medical assistance with forceps, ventouse or Caesarean section. Even for babies born after a trouble free natural labour, their skull will have been squeezed to allow it to pass through the birth canal, and the skull needs to rebalance and relieve strain patterns. This is all the more so for babies born with medical assistance. The sucking reflex assists in this process.

The embodiments of soother-resembling medical articles described hereinbelow and incorporating the teachings of this disclosure were developed following the Inventor's professional observation that babies, particularly those born after medical intervention, derive particular benefit from sucking on a little finger of a parent or a nurse or midwife, with the finger reaching to the roof of the mouth or hard palate. The portion of the skull lying immediately above this region of the mouth comprises the palatine and maxilla bones with two sutures, namely the median palatine suture and transverse palatine suture, which in turn influence the sphenoid bone which overlies this structure and extends to either side of the mouth. The benefit achieved by sucking a finger is believed to be because balance of this structure including the palatine, maxilla and sphenoid bones is crucial to the mechanics of the skull, as this structure lies at the centre of the head. Six out of twelve cranial nerves pass through it and attach directly into the spinal cord. The pituitary gland, which serves a master controlling function on the other endocrine glands, sits immediately above the sphenoid bone. Strain patterns occur in the head and spine during pregnancy or at birth and plagiocephaly can arise, due to the flexibility present in the skull, even after birth from following the guidance to always place a baby on its back to avoid the possibility of cot death syndrome. If left uncorrected strain patterns and plagiocephaly contribute to other physical and emotional challenges of childhood, such as Dyslexia, ADHD, headaches, colic, irregular head shape, irritable children, reflux, poor sleeping patterns, emotional issues and lack of growth. Medical intervention such as cranial adjustment and chiropractic may result in dramatic improvement. The embodiments of soother-resembling medical articles described hereinbelow may provide an alternative to such intervention, or additional assistance, using no more that the baby's natural sucking reflex to achieve an effect.

Research has shown that when a baby's skull and body rebalance, it will relax, sleep and start to thrive. However, as a baby grows, strain patterns such as dips and ridges in their heads may re-establish. Use of the embodiments of soother-resembling medical articles described hereinbelow may help to keep their heads and spine open and mobile and avoid tension building up in the bones of the head, the meninges and spine.

SUMMARY OF DISCLOSURE

In accordance with the present disclosure, there is provided a medical article resembling a soother, the article comprising a teat portion for insertion into a baby's mouth and a mouth shield portion adapted to fit over the baby's face around the mouth and serving in use to limit the extent of insertion of the teat portion into the baby's mouth; the teat portion being of sufficient length and extending from the mouth shield at an angle towards the hard palate in the roof of the mouth when the shield is so fitted whereby a distal end portion of the teat portion is adapted in use to bear against the hard palate in the roof of the mouth; and the teat portion being formed without voids with a relatively soft surface layer and a relatively harder inner core.

Preferred embodiments have one or more of the following features: The mouth shield portion is suitably curved both laterally and in a vertical plane so as to generally conform to the external geometry of a baby's face around its mouth, and is provided with openings therethrough, the teat portion being attached to a central portion of the mouth shield, and the teat portion defining a principal longitudinal axis. The angle in a vertical-plane by which this principal longitudinal axis departs from the common axis of curvature laterally and vertically of the mouth shield at the central portion being around 5°, preferably 7.5° or less, and most preferably within the range from 5 to 7.5°. The relatively softer surface layer and the relatively harder core are preferably formed from the same plastics material or from compatible plastics materials, but with different Shore Hardness. The core is preferably two or more times harder than the surface layer, more preferably five or less times harder, and most preferably between two and five times harder. The core and surface layer are suitably formed by a co-moulding or over-moulding technique. At least the surface layer is preferably formed of medical grade silicone plastics material. The thickness of the surface layer, at least at its distal end portion, is preferably 1 mm or more, more preferably 4 mm or less, and most preferably within the range from 1 to 4 mm. The thickness of the core at its widest extent, which is suitably adjacent its distal end portion, which is suitably rounded, is preferably 4 mm or more, more preferably 10 mm or less, and most preferably within the range of 4 to 10 mm. Alternatively, the teat portion may be generally of strip form. The strip-form teat portion may have a proximal end portion that extends generally in the direction of the common axis, and an intermediate portion provided with an S-bend, whereby the distal end portion is displaced from the common axis of the mouth shield. A rounded protrusion may be formed on an upper surface of the teat portion adjacent the distal end portion for contact with the hard palate in use of the article.

The soother-resembling medical article may be formed in a range of sizes to suit babies from premature to large normal birth weight. Babies more than one year old are unlikely to derive any significant benefit. The length of the teat portion is preferably 25 mm or more for a small or premature newborn, and more preferably in the range from 25 to 30 mm. For an average or large birth weight baby, the length of the teat portion is preferably around 50 mm.

BRIEF DESCRIPTION OF THE DRAWINGS

Reference may now be made to the description of preferred embodiments by way of example only with reference to the accompanying drawings, in which.

DESCRIPTION OF PREFERRED EMBODIMENTS

Figure 1:
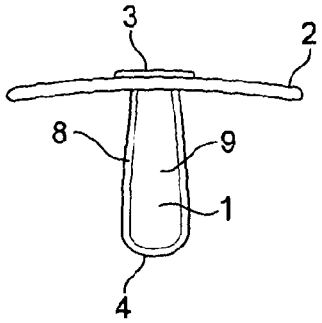
FIG. 1 is a top plan view of a first embodiment of soother-resembling medical article.
Figure 2:
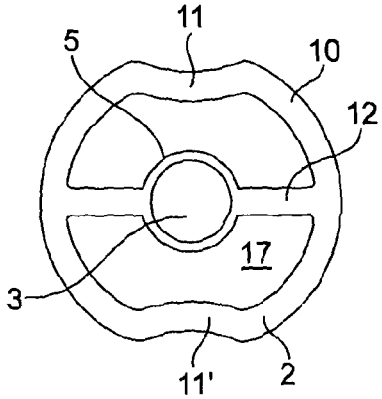
FIG. 2 is a rear elevation of the article of FIG. 1.
Figure 3:
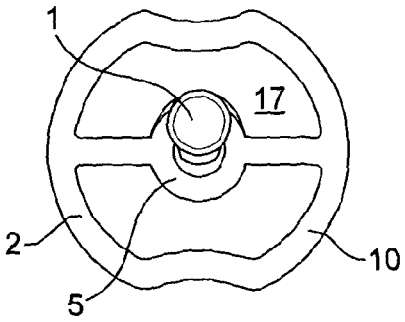
FIG. 3 is a front elevation of the article of FIGS. 1 and 2.

The article shown in FIGS. 1 to 4 plainly resembles a soother. It has a teat portion 1 for insertion into a baby's mouth and a mouth shield portion 2 adapted to fit over the baby's face around the mouth and serving in use to limit the extent of insertion of the teat portion 1 into the baby's mouth. A cap or plug 3 holds the teat portion 1 in place on the mouth shield portion 2. Alternatively a ring or graspable member may be employed, in place or in addition to a simple cap or plug 3, to allow an adult to hold the soother-resembling article.

The teat portion of a conventional soother is required by the aforementioned British Standard to have a maximum penetration of 35 mm. Preferably a range of sizes for the teat portion 1 of the soother-resembling article is provided for differently sized babies. For a small or premature baby, the length of the teat portion is preferably 25 mm or more, and more preferably in the range from 25 to 30 mm; while for an average birth weight baby, the length of the teat portion is preferably around 50 mm. Large babies, or those needing to use the soother-resembling article for some while after birth may require a teat portion with a length in excess of 50 mm.

The important thing, in accordance with the present teaching, is that the teat portion 1 should be of sufficient length and extend from the mouth shield portion 2 at an angle towards the hard palate in the roof of the mouth, so that in use distal end portion 4 of the teat portion 1, which is suitably rounded, bears gently against the hard palate in the roof of the mouth.

Figure 4:
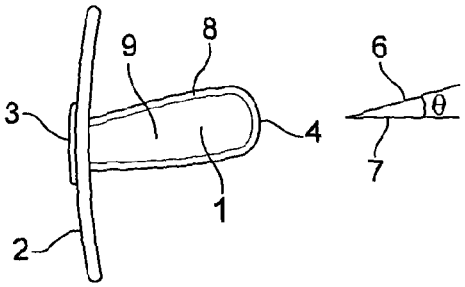
FIG. 4 is a side elevation of the article of FIGS. 1 to 3.
Figure 5:
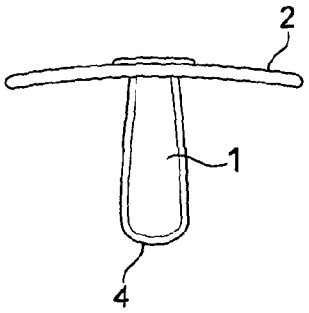
FIGS. 5 to 8 are similar views for an alternative embodiment of soother-resembling medical article.
Figure 6:
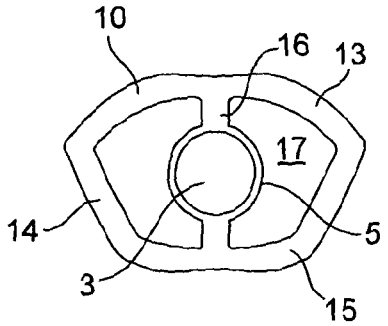
Figure 7:
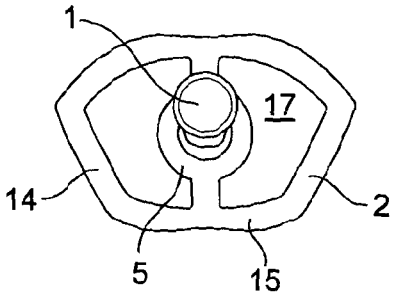
Figure 8:
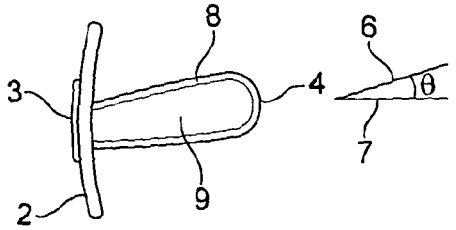

The mouth shield portion 2 is suitably curved both laterally and in a vertical plane, as can be seen in the top plan and side elevational views of FIGS. 1 and 4, so as to generally conform to the external geometry of a baby's face around its mouth. Teat portion 1 is attached to a central portion 5 of the mouth shield 2, and defines a principal longitudinal axis 6. The angle θ by which this principal longitudinal axis 6 departs in a vertical plane from the common axis 7 of curvature laterally and vertically of the mouth shield portion 2 at its central portion is suitably around 5°, preferably 7.5° or less, and most preferably within the range from 5 to 7.5°, in order to for the distal end portion 4 to point towards and, if sufficiently long, reach the hard palate in the roof of the mouth.

Teat portion 1 is formed without voids. In order that the distal end portion 4 may bear against the hard palate in the roof of the baby's mouth with gentle but firm pressure, it is formed without voids and is provided with a relatively soft surface layer 8 and a relatively harder inner core 9. The relatively softer surface layer 8 and the relatively harder core 9 are preferably formed from the same plastics material or from compatible plastics materials, but with different Shore Hardness. The core is preferably two or more times harder than the surface layer, more preferably five or less times harder, and most preferably between two and five times harder. The core and surface layer can be readily formed by co-moulding or over-moulding techniques of the kind commonly used for handles of everyday articles such as toothbrushes. Whether the two layers are formed of the same or merely compatible materials, at least the surface layer 8 is preferably formed of medical grade silicone plastics material.

A suitable thickness for the surface layer 8 of the teat portion 1, at least at its distal end portion 4, is preferably 1 mm or more, more preferably 4 mm or less, and most preferably within the range from 1 to 4 mm. The thickness of the core 9 at its widest extent, which, as shown in FIG. 4, is adjacent distal end portion 4, is preferably 4 mm or more, more preferably 10 mm or less, and most preferably within the range of 4 to 10 mm.

Numerous variations are feasible. FIGS. 5 to 8 show one variation. Whereas, the peripheral portion 10 of mouth shield portion 2 in the first embodiment is generally circular, apart from a portion 11 at its top edge shaped to accommodate the baby's nose, and a balancing portion 11' at its bottom edge, and the central portion 5 of the mouth shield portion 2 to which the teat portion 1 is joined is supported by horizontal crossbar 12, the mouth shield portion 2 of the second embodiment of FIGS. 5 to 8 is much shallower in vertical height having a peripheral portion 10 with a curved upper edge portion 13, tapered side edges 14 and an only slightly curved bottom edge 15. The central portion 5 of this second embodiment is mounted on a vertical cross-bar 16. The differences between the two mouth shield portions are not simply aesthetic. Depending on the particular shape and dimensions of the baby's face, one may be more comfortable than the other.

Figure 9A:
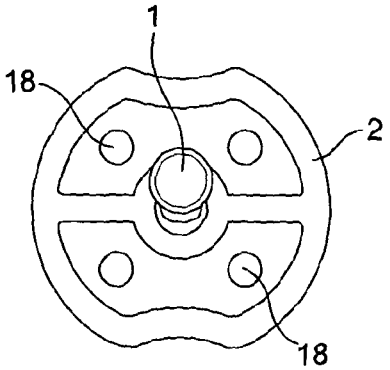
FIGS. 9*a* to 9*d* show variations in the mouth shield portions.
Figure 9B:
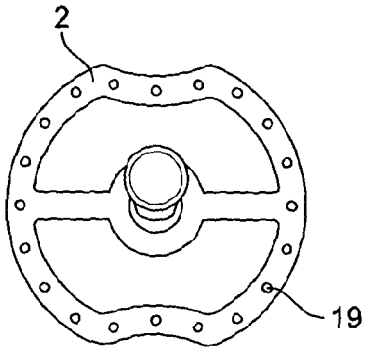
Figure 9C:
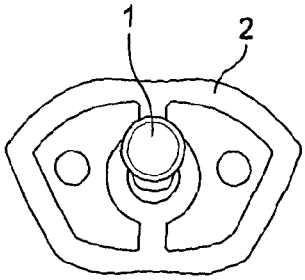

The voids 17 in the respective mouth shield portions 2 may be largely filled in as shown in FIGS. 9*a* and 9*c*, but, in that case, breathe holes 18 with a diameter of 5 mm or more should be provided.

Figure 9D:
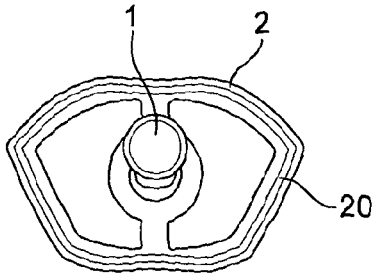

The peripheral portion 10 may be formed with raised dimples 19 (FIG. 9*b*) or a raised rib 20 (FIG. 9*d*) extending part or the whole way around the peripheral portion. These serve both to provide an interesting texture for the baby and serve to hold the shield away from the baby's face to ensure air circulation.

Figure 10A:
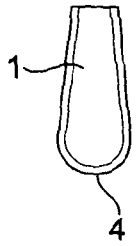
FIGS. 10*a*, 10*b* and 10*c* show respective top plan, front elevation and side elevational views of just the teat portion of a further variation.
Figure 10B:
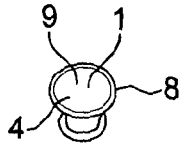
Figure 10C:
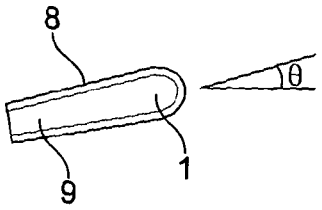
Figure 11:
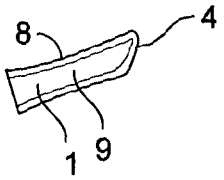
FIG. 11 shows a side elevational view of just the teat portion of a yet further variation.
Figure 12:
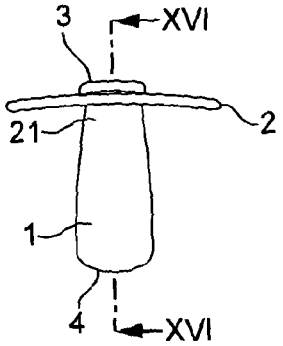
FIG. 12 is a top plan view of an alternative embodiment of soother-resembling medical article.
Figure 13:
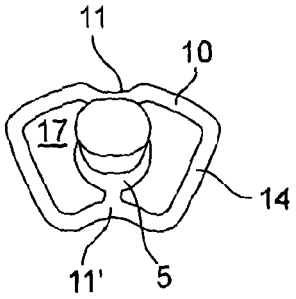
FIG. 13 is a front elevation of the article of FIG. 12.
Figure 14:
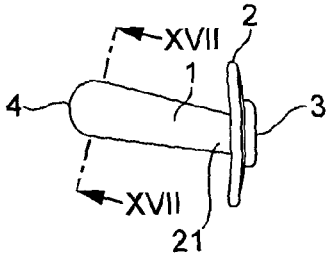
FIG. 14 is a side elevation of the article of FIGS. 12 and 13.
Figure 15:
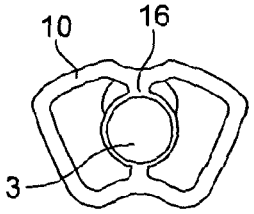
FIG. 15 is a rear elevation of the article of FIGS. 12 to 14.
Figure 16:
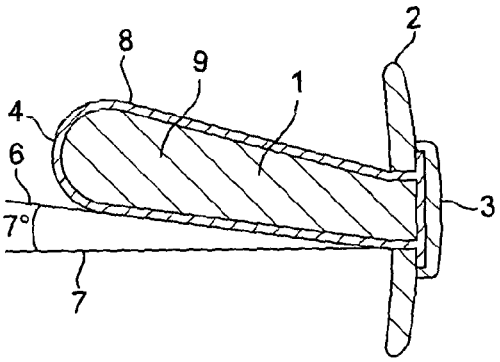
FIG. 16 is a sectional view taken along the line XVI-XVI in FIG. 12.
Figure 17:
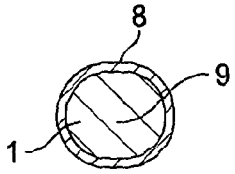
FIG. 17 is a sectional view taken along the line XVII-XVII in FIG. 14.
Figure 18:
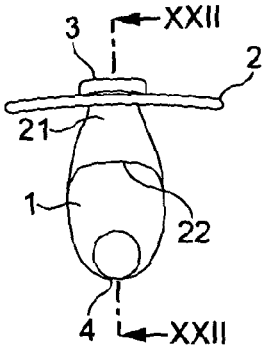
FIGS. 18 to 23 are similar views to FIGS. 12 to 17 for an alternative embodiment of soother-resembling medical article.
Figure 19:
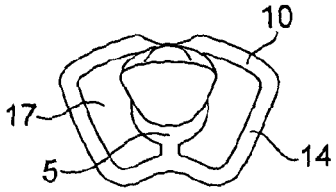
Figure 20:
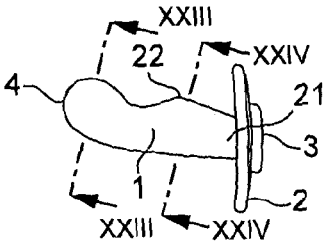
Figure 21:
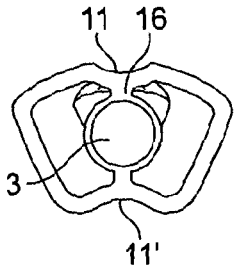
Figure 22:
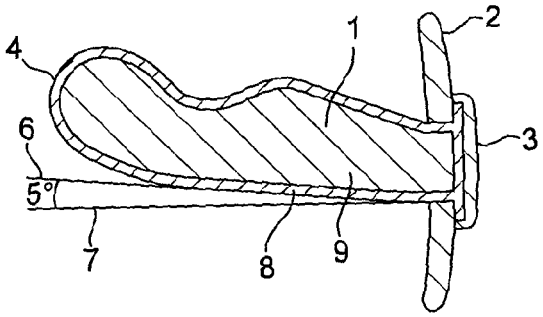
Figure 23:
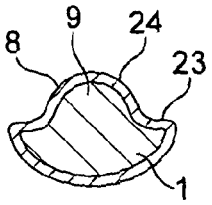
Figure 24:
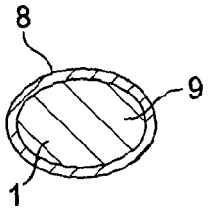
FIG. 24 is a sectional view taken along the line XXIV-XXIV in FIG. 20.
Figure 25:
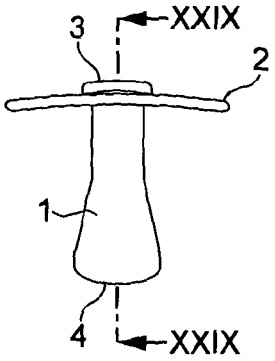
FIGS. 25 to 30 are similar views to FIGS. 12 to 17 for another alternative embodiment of soother-resembling medical article.
Figure 26:
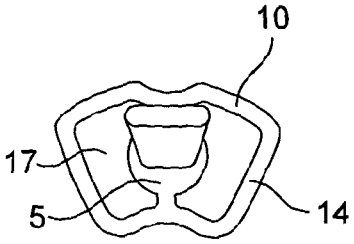
Figure 27:
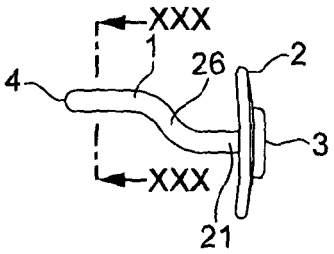
Figure 28:
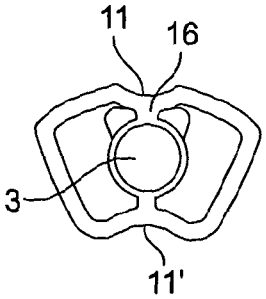
Figure 29:
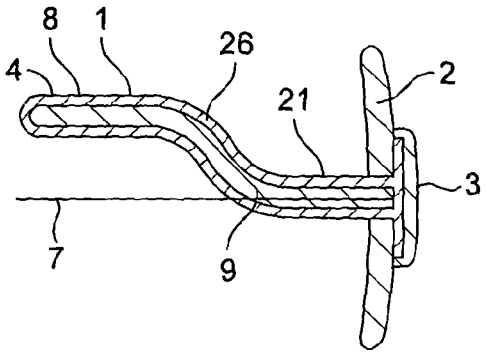
Figure 30:
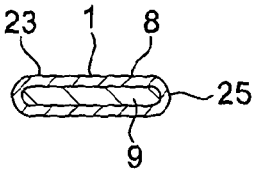
Figure 31:
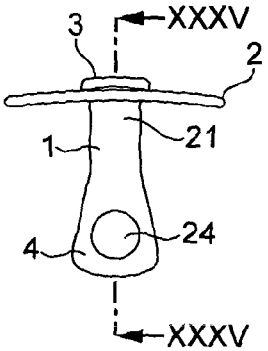
FIGS. 31 to 36 are similar views to FIGS. 12 to 17 for another alternative embodiment of soother-resembling medical article.
Figure 32:
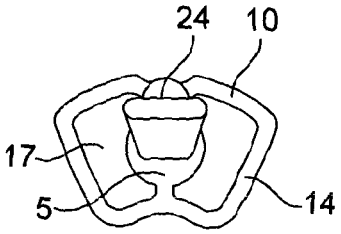
Figure 33:
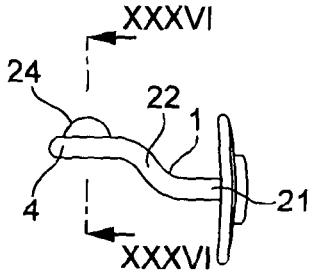
Figure 34:
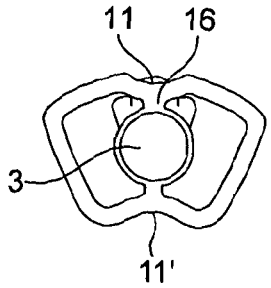
Figure 35:
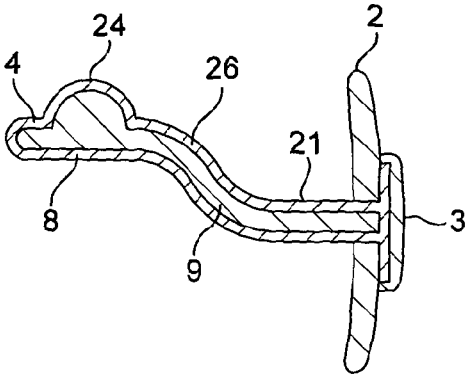
Figure 36:
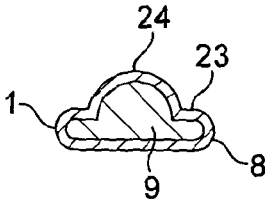

Variations may also be made in the teat portion. Whereas in all the arrangements of FIGS. 1 to 9, the teat portion was circular in section at all positions along its length normal to the principal longitudinal axis, as shown in FIGS. 10*a*, 10*b* and 10*c*, the teat portion may be flattened slightly, being wider than it is thicker. Alternatively or additionally, it may have a textured and sloped distal end portion, as shown in the side elevational view of FIG. 11.

FIGS. 12 to 17 show another variation of soother-resembling medical article somewhat similar to the embodiment of FIGS. 5 to 8, except that the teat portion 1 is slightly wider horizontally than it is thick in vertical section. The angle θ by which the principal longitudinal axis 6 departs in a vertical plane from the common axis 7 is 7° in this embodiment. The peripheral portion 10 of mouth shield 2 has a somewhat more pronounced portion 11 at its top edge to accommodate the baby's nose, and a balancing portion 11' at its bottom edge.

FIGS. 18 to 24 show a soother-resembling medical article with a differently shaped teat portion 1. In this embodiment the angle θ by which the principal longitudinal axis 6 departs in a vertical plane from the common axis 7 is 5°. The teat 1 has a fattened shape, with a significantly greater lateral extent than vertical extent. Adjacent its proximal end 21, the teat is generally elliptical in section, but from position 22 onwards towards distal end portion 4, it becomes progressively more flattened on its upper surface 23 until it has a semi-ovoid shape apart from a rounded protrusion 24 in the centre of upper surface 23 adjacent the distal end portion. The rounded protrusion 24 is designed to bear gently against the hard palate in the roof of the mouth.

The embodiment of FIGS. 25 to 30 has a teat portion 1 with a quite different form to that of previously described embodiments, generally taking a strip like form with rounded edges 25, but, as with all previous embodiments, it has a relatively hard inner core 9 and a relatively softer surface layer 8. Proximal end portion 21 is formed as a straight strip extending in the direction of principal axis 7 of the mouth shield 2. An intermediate portion 26 is formed with a shallow S-bend so that distal end portion 4 is deflected from principal axis 7. Relative to the point of connection between proximal end portion 21 and the mouth shield 2, teat 1 effectively extends to distal end portion 4 at an angle to the principal axis. Teat portion 1 has an increasing lateral width towards distal end portion 4 which is rounded off. Flat upper surface 23 of the strip-like teat portion will bear against the roof of the mouth in use.

The embodiment of FIGS. 31 to 36 differs from that of FIGS. 25 to 30 only in that flat upper surface 23 of the teat portion 1 is here provided with a rounded protrusion 24, in similar fashion to the embodiment of FIGS. 18 to 24.

The invention claimed is:

1. A medical article adapted for use as a soother, the article comprising a teat portion for insertion into a baby's mouth, and a mouth shield portion adapted to fit over a baby's face around the mouth and serving in use to limit insertion of the teat portion into the baby's mouth; the teat portion extending at an angle from the mouth shield portion and being of sufficient length such that the teat portion is adapted to extend at the angle towards a hard palate in a roof of the mouth when the mouth shield portion is so fitted over the baby's face, whereby a distal end portion of the teat portion is adapted in use to bear against the hard palate in the roof of the mouth; and the teat portion being formed without voids and with an outer surface layer and an inner core, wherein the outer surface layer has a lower Shore Hardness than the inner core, wherein the outer surface layer defines an area extending from the mouth shield portion to the distal end portion, and wherein the inner core is solid and fills the area.

2. A medical article according to claim 1, wherein the mouth shield portion is curved both laterally and in a vertical plane so as to generally conform to the baby's face around the mouth, and is provided with openings therethrough, the teat portion being attached to a central portion of the mouth shield portion at a point of attachment, and the teat portion defining a principal longitudinal axis extending from the point of attachment.

3. A medical article according to claim 2, wherein the vertical plane by which the principal longitudinal axis departs from a common axis of curvature of the mouth shield at the central portion is an angle of 5° or more, and 7.5° or less.

4. A medical article according to claim 3, wherein the teat portion is of a generally strip form and has a proximal end portion that extends generally in the direction of the common axis, and an intermediate portion provided with an S-bend, whereby the distal end portion is displaced from the common axis.

5. A medical article according to claim 1, wherein the outer surface layer and the inner core are formed from the same plastics material or from compatible plastics materials having different Shore Hardnesses.

6. A medical article according to claim 5, wherein the inner core is between two and five times harder than the outer surface layer.

7. A medical article according to claim 1, wherein the inner core and the outer surface layer are formed by a co-moulding or over-moulding technique.

8. A medical article according to claim 1, wherein the outer surface layer is formed of medical grade silicone plastics material.

9. A medical article according to claim 1, wherein the outer surface layer has a thickness at the distal end portion of 1 mm or more, and 4 mm or less.

10. A medical article according to claim 1, wherein the thickness of the inner core at its widest extent is 4 mm or more, and 10 mm or less.

11. A medical article according to claim 10, wherein the widest extent is adjacent the distal end portion, which is rounded.

12. A medical article according to claim 1, wherein the distal end portion is flattened.

13. A medical article according to claim 1, wherein the teat portion is of a generally strip form.

14. A medical article according to claim 1, wherein a rounded protrusion is formed on an upper surface of the teat portion adjacent the distal end portion for contact with the hard palate in use of the article.

15. A medical article according to claim 1, wherein the teat portion has a length from 25 to 30 mm.

16. A medical article according to claim 1, wherein the teat portion has a length of around 50 mm.

* * * * *